US007743453B2

(12) United States Patent
Kresse et al.

(10) Patent No.: US 7,743,453 B2
(45) Date of Patent: Jun. 29, 2010

(54) WIPING DEVICE FOR WIPING SURFACES TO BE CLEANED

(75) Inventors: Franz Kresse, Hilden (DE); Heiko Faubel, Wermelskirchen (DE)

(73) Assignee: Ecolab Inc., St. Paul, MN (US)

( * ) Notice: Subject to any disclaimer, the term of this patent is extended or adjusted under 35 U.S.C. 154(b) by 842 days.

(21) Appl. No.: 10/487,605

(22) PCT Filed: Aug. 22, 2002

(86) PCT No.: PCT/EP02/09371

§ 371 (c)(1),
(2), (4) Date: Aug. 2, 2004

(87) PCT Pub. No.: WO03/020100

PCT Pub. Date: Mar. 13, 2003

(65) Prior Publication Data

US 2005/0120499 A1 Jun. 9, 2005

(30) Foreign Application Priority Data

Aug. 30, 2001 (DE) ..... 101 42 084

(51) Int. Cl.
*A47L 13/10* (2006.01)

(52) U.S. Cl. ..... 15/228; 15/229.4; 15/229.8

(58) Field of Classification Search ..... 15/228, 15/229.1–229.2, 229.4, 229.6, 229.8, 231, 15/229.5

See application file for complete search history.

(56) References Cited

U.S. PATENT DOCUMENTS 1,618,553 A * 2/1927 Saul ..... 15/229.8
2,648,859 A * 8/1953 Flagstad ..... 15/148
3,593,359 A 7/1971 Strauss
3,986,225 A * 10/1976 Komatsu ..... 15/147.2
4,971,471 A * 11/1990 Sloan ..... 401/203
5,390,390 A * 2/1995 Kresse et al. ..... 15/228

(Continued)

FOREIGN PATENT DOCUMENTS

DE 2229824 11/1973

(Continued)

*Primary Examiner*—Shay L Karls
(74) *Attorney, Agent, or Firm*—Merchant & Gould P.C.

(57) ABSTRACT

The invention relates to a wiping device for wiping surfaces to be cleaned, especially floor surfaces, comprising a plate-type or frame-type wiping element holder (1), preferably in an essentially long, rectangular form, and a wiping element (4) consisting of textile material or the like, which is adapted and fixed to the wiping element holder (1). Said wiping element (4) respectively comprises, on the upper side facing the wiping element holder (1), close to the two opposing sides, and close to the narrow sides in the long, rectangular form, a narrow fixing strip (5), which is applied with its ends to the wiping element (5) [sic]. Said fixing strip extends approximately transversally on the wiping element holder (1) when the wiping element (4) is fixed to the same (1). Position fixing arrangements are provided on the wiping element holder (1), where the fixing strips (5) should extend when the wiping element is fixed (4). The fixing strips (5) especially consist of textile material or the like and are sewn at the ends thereof to the wiping element (4). The position fixing arrangements (7) are especially embodied as edge recesses starting from the ends, in which the fixing strips (5) are placed in the correct position.

12 Claims, 5 Drawing Sheets

U.S. PATENT DOCUMENTS

| | | | | |
|---|---|---|---|---|
| 5,680,667 | A | 10/1997 | Kresse | |
| 2001/0006589 | A1 * | 7/2001 | Fodrocy et al. | 401/279 |

FOREIGN PATENT DOCUMENTS

| | | | |
|---|---|---|---|
| DE | 2914230 | | 10/1980 |
| DE | 3823456 | | 7/1989 |
| DE | 3808310 | A1 * | 9/1989 |
| DE | 4300920 | | 7/1994 |
| DE | 29822052 | | 2/1999 |
| DE | 19823044 | | 10/1999 |
| DE | 20000566 | | 3/2000 |
| EP | 0629374 | | 12/1994 |
| EP | 0691098 | | 1/1996 |
| EP | 0713671 | | 5/1996 |
| WO | WO9423635 | | 10/1994 |

* cited by examiner

WIPING DEVICE FOR WIPING SURFACES TO BE CLEANED

FIELD OF THE INVENTION

The present invention relates to a wiping device for wiping surfaces that are to be cleaned, especially floor surfaces, having the features of the precharacterizing part of claim 1. Parts of the wiping device that are essential according to the invention are on the one hand a wiping element holder, and on the other hand the removable wiping element that is to be fixed to the wiping element holder.

BACKGROUND OF THE INVENTION

Wiping devices of the type in question have been known for decades, and are colloquially referred to as floor wiping elements (DE 29 14 230 A1). Such a wiping device has in the first place a wiping element holder on which a handle socket is mounted, generally via a cardan joint, so that it can swivel in all directions, and in which a more or less long handle can be inserted. The wiping element holder itself is designed as a generally longitudinally extending rectangular plate or as a correspondingly longitudinally extending rectangular wire frame, optionally with an attachment plate (DE 29 14 230 A1; from the known prior art). The term "longitudinally extending rectangular" also includes in this connection shapes that in plan view deviate slightly from an exact rectangular shape, in particular a trapezoidal shape.

In addition to wiping element holders with a fixed holder or with a fixed wire frame, there have also been known for decades (DE 29 14 230 A1) wiping element holders with a plate or a wire frame that can fold approximately in the middle, and provided with corresponding actuation means.

A wiping element consisting of textile or textile-like material and adapted to the wiping element holder, generally referred to as a flat wiping element, is secured to the latter. This fixing can of course be released since the wiping element has to be squeezed out and/or washed from time to time.

For purposes of fixing to the wiping element holder, the wiping element according to the prior art has in each case on the side facing the wiping element holder and in the vicinity of the narrow sides a fixing element in the form of a securing pocket stitched on three sides. In the case of wiping element holders with a fixed plate or wire frame the insert pockets consist of elastically stretchable material so that they can be sufficiently stretched when pulled over the relevant end of the wiping element holder. In some cases one of the insert pockets is also slit over a more or less long section so as to facilitate the attachment of the wiping element to the wiping element holder.

The wiping element can be attached more easily to the wiping element holder in the case of wiping element holders having a foldable plate or wire frame ((DE 29 14 230 A1). In the folded, i.e. shortened state, the wiping element holder fits between the two insert pockets. By pressing on the folded wiping element holder the latter is brought into the inclined position, whereupon the ends slide into the insert pockets. The wiping element holder is now locked in the extended position and the wiping device can then be used as intended. With such quick-change devices the insert pockets are as a general rule not made of an elastically stretchable material. Often the insert pockets are made of the same or a similar material as the basic fabric of the wiping element itself.

The flat wiping elements widely used in practice with insert pockets stitched on three sides are complicated to manufacture and require expensive production equipment. A common complaint in practice is that the insert pockets become full of water when the wiping elements are rinsed out and the wiping element therefore cannot be adequately dried. Finally, the insert pockets are not part of the cleaning-active mass of the wiping element, although they account for between 7% and 12% of the total weight of the wiping element. Accordingly, 7% to 12% of the material costs of a commercially available flat wiping element with insert pockets are wasted as regards the cleaning function. The same also applies to the costs incurred in washing the wiping elements.

In general it has to be remembered that such wiping elements are widely employed for multifarious purposes in professional use, where business operating margins are low and thus any cost savings are welcomed.

Attempts have already been made to obviate the aforedescribed known disadvantages of wiping elements with insert pockets sewn at the ends, by providing the lower side of the wiping element holder and the upper side of the wiping element with Velcro-type locking elements (DE 22 29 824 AI). These wiping devices have not been widely adopted in practice since, quite apart from the fact that they are complicated and costly to produce, above all the removal of the wiping element necessitates a procedure that can only be performed manually, namely the detachment of the wiping element from the wiping element holder. In contrast to this, particularly when using quick-change holders with a foldable plate or foldable wire frame, in the case of wiping elements provided with insert pockets at the end the dirty wiping element can be removed without the wiping element actually having to be handled.

SUMMARY

The object of the present invention is to develop and modify the known wiping device described in detail in the introduction so that it can be used even more cost-effectively and expeditiously. A further object is also to develop a wiping element holder per se and a correspondingly associated wiping element.

The problem outlined above is solved by the wiping device according to the invention having the features described herein. According to the invention the end insert pockets stitched on three sides are dispensed with. Instead, only narrow fixing strips are used, underneath which the plate or the wire frame of the wiping element holder can be inserted. The fixing of the wiping element on the wiping element holder is thereby accomplished just as effectively as when using insert pockets. The insert pockets of the wiping device known from the prior art have a further function however, namely to effect a coincident alignment of the wiping element holder and the wiping element. This is now performed by the narrow fixing strips in conjunction with the position fixing members provided on the wiping element holder. This prevents an undesirable and thus excessive longitudinal displacement of the wiping element relative to the wiping element holder.

It is obvious that, given the flexibility of the wiping element and fixing strips due to the material from which they are made, there can be no absolutely exact positional fixing of the wiping element on the wiping element holder. A slight displacement of the wiping element relative to the wiping element holder is however also perfectly acceptable in practice. Of importance nevertheless is the recognition, on which the present invention is based, that the narrow fixing strips in conjunction with the position fixing members are sufficient to ensure a fixing of the wiping element to the wiping element holder that is satisfactory in practice.

At the same time quite substantial advantages are also achieved. The production costs of the flat wiping element are significantly reduced by dispensing with the insert pockets stitched on three sides. The omission of the insert pockets achieves a saving of ca. 7% to 12% of the overall weight of the wiping element. The washing costs are also correspondingly reduced. The amount of material used is also reduced by a corresponding amount. The drainage of water from the wiping element after the latter has been rinsed is more effective since the narrow fixing strips do not trap any water.

The present invention also provides a suitably designed wiping element holder as well as a suitably designed wiping element per se.

In an especially advantageous manner, the teaching further solves the aforedescribed problem by a device is characterized through a specially formed wiping element that is double-layered and reversible.

Until now, flat wiping elements had an active cleaning bottom side and the top side provided with the fastening elements. Thus half of the wiping element had no cleaning function. Yet the whole wiping element had to be washed when it became soiled on the active cleaning side. The teaching described here realizes a wiping device with a wiping element having two active cleaning sides, since the wiping element as a whole is reversible, in particular thanks to the convenient arrangement of the fixing strips. With this, one not only has two active cleaning sides, whereas previously only a single active cleaning side was available in a flat wiping element, but one can also design the two active cleaning sides differently and thus achieve different cleaning effects.

Also described is an especially advantageous wiping device. To this extent, a wiping element holder per se adapted to this device, as well as a correspondingly configured wiping element holder per se, are also objects of the invention.

BRIEF DESCRIPTION OF THE DRAWINGS

The invention is described in more detail hereinafter with the aid of drawings simply illustrating some embodiments. Modifications and developments of the invention that are also of general interest are described in conjunction with the description of the embodiments. In the drawings.

DETAILED DESCRIPTION OF THE INVENTION

The present invention provides a wiping device, colloquially also known as a floor wiping element for wiping surfaces to be cleaned, in particular floor surfaces. Such wiping devices may however also be used for other surfaces that have to be cleaned.

Figure 1:
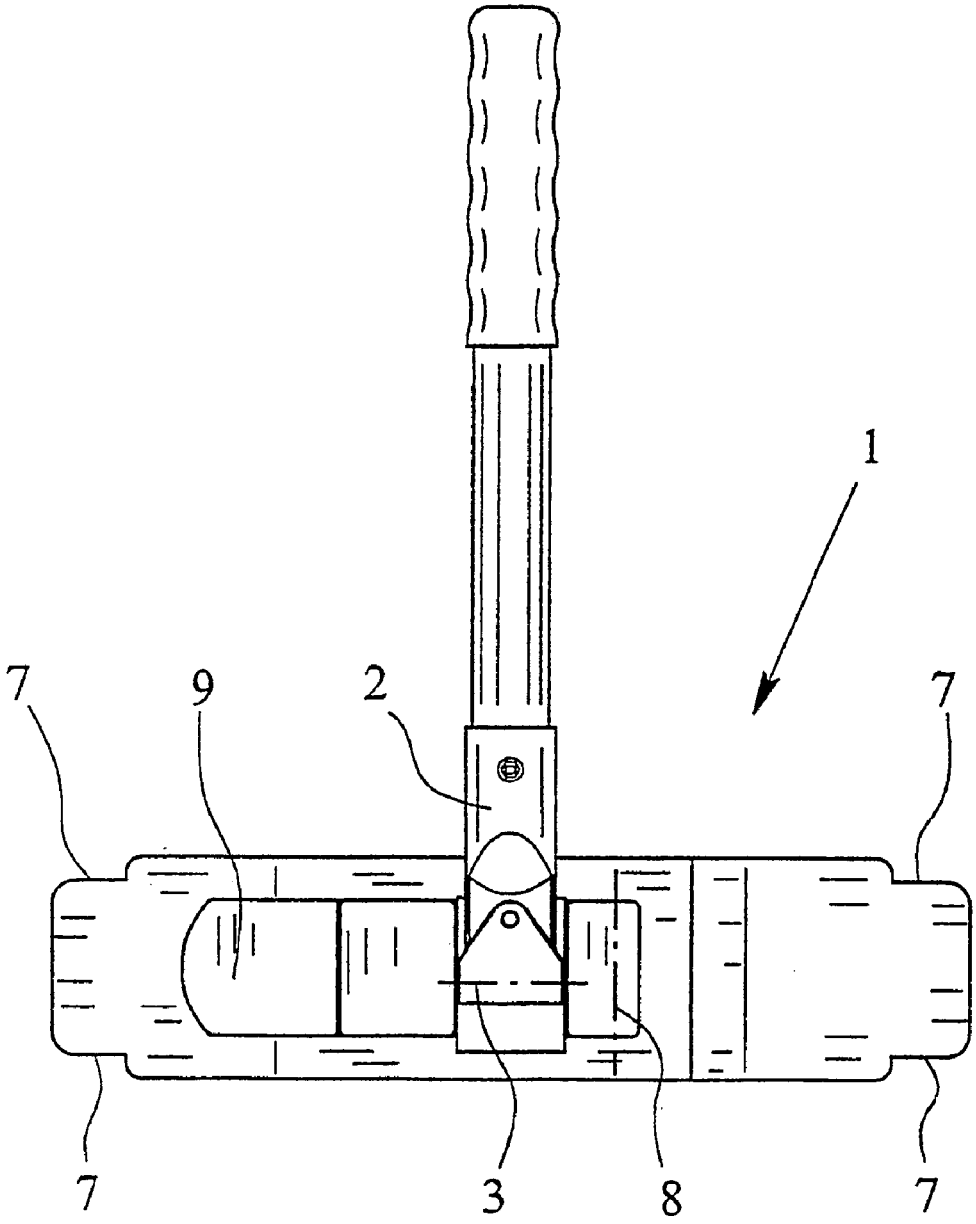
FIG. 1 shows a preferred embodiment of a wiping element holder of a wiping device according to the invention.

FIG. 1 shows a plate-type wiping element holder 1 made of plastics material. In addition to plate-type wiping element holders there are also frame-type wiping element holders, i.e. wiping element holders whose attachment surface is formed in the manner of a wire frame (DE 29 14 230 A1). The invention provides wiping devices with all types of wiping element holders 1.

The wiping element holder 1 illustrated in FIG. 1 has a substantially longitudinally extending rectangular shape typical of such wiping element holders. Corresponding wiping element holders that appear slightly trapezoidal in plan view may also be employed. Shapes deviating somewhat from the above are also covered by the expression "substantially longitudinally extending rectangular shape". On its upper side the wiping element holder has a handle socket 2 that is connected via a cardan joint 3 to the wiping element holder 1 as such. A handle (not shown in FIG. 1) that can be inserted or screwed into the handle socket 2 can thus guide the wiping element holder in almost any desired relative position over the surface to be cleaned.

Figure 2:
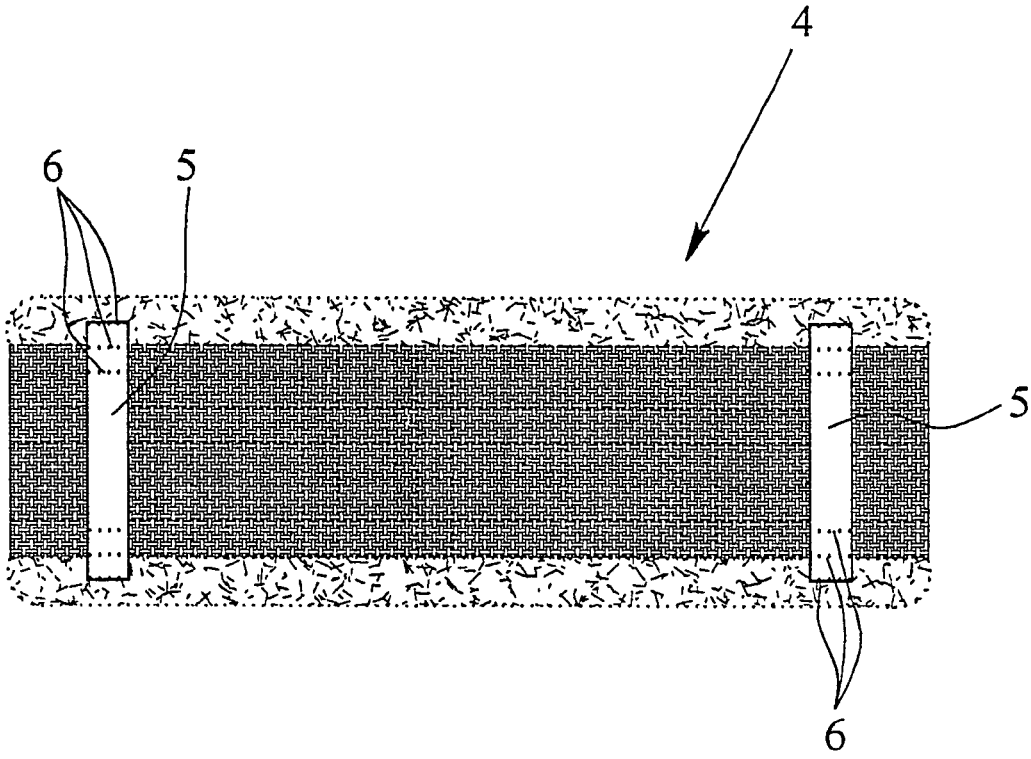
FIG. 2 shows a preferred embodiment of a wiping element of a wiping device according to the invention.

FIG. 2 shows a wiping element 4 to be secured to the wiping element holder 1 and that matches the latter. This wiping element 4 generally consists of textile or textile-like material, often of a synthetic fiber or synthetic fiber mixed fabric with fringes arranged on the cleaning surface and on the edge in order to optimize the cleaning effect. Nowadays suitable microfiber products are frequently used for this purpose.

Figure 3:
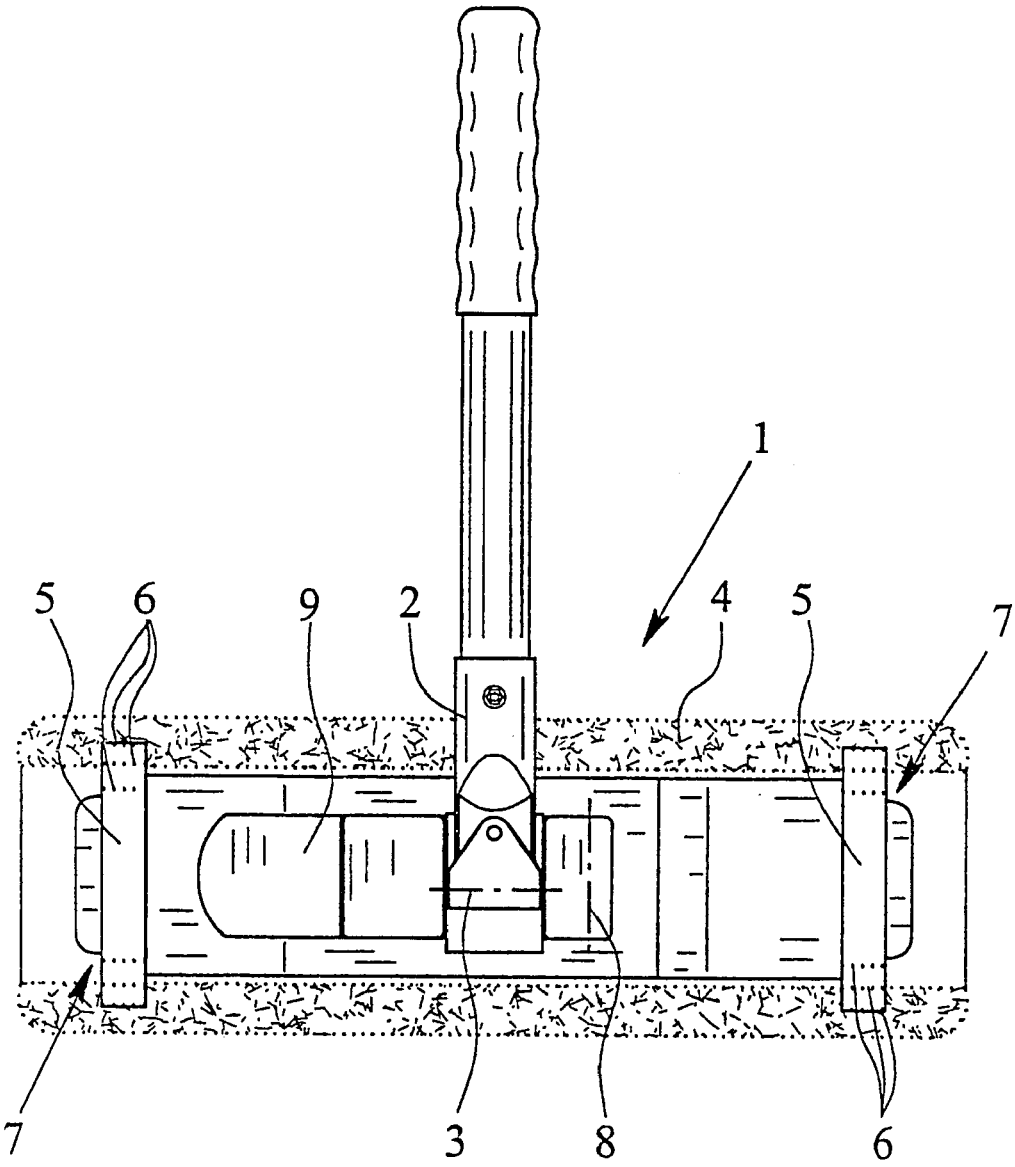
FIG. 3 shows a wiping device consisting of a wiping element holder and wiping element according to FIGS. 1 and 2.

As FIGS. 2 and 3 in conjunction show, in each case the wiping element 4 has on the upper side facing the wiping element holder 1 adjacent to the narrow sides, a fixing element for securing the wiping element 4 to the wiping element holder 1. This fixing element runs crosswise over the wiping element holder 1 when the wiping element 4 is secured in position (FIG. 3). In the illustrated embodiment the fixing elements are adjacent to the narrow sides of the wiping element 4 of a longitudinally extended rectangular shape. Corresponding arrangements that are suitable for the fixing of the wiping element 4 to the wiping element holder 1 are also available for other shapes of the wiping element 4.

It is essential that the fixing elements on the upper side of the wiping element 4 are designed as narrow fixing strips 5 attached only at their ends to the wiping element 4, and that position fixing members 7 are provided on the wiping element holder 1 at those places where the fixing strips 5 are to run when the wiping element 4 is secured in position. The position fixing arrangements 7 ensure that no undesired longitudinal displacement of the wiping element 4 relative to the wiping element holder 1 can occur during use of the wiping device. Transverse displacements are of course already prevented by the fixing strips 5. In this respect the function of the fixing strips 5 is the same as the function of the insert pockets stitched on three sides that are employed in the prior art. The fixing strips 5 cannot however fulfill the function of the insert pockets as regards a longitudinal displacement. The position fixing arrangements 7 on the wiping element holder 1 now fulfill this function instead, various embodiments of which will be described in more detail hereinafter.

In principle there are no restrictions as regards the material of the fixing strips 5. These strips may for example consist of plastics, leather, and possibly even of corrosion-resistant metal. For production reasons however it is recommended that the fixing strips 5 consist of textile or textile-like material. In particular it is recommended that the fixing strips 5 consist of the same material as the basic fabric of the wiping element 4. In all respects there are considerable advantages in making the fixing strips 5 of textile or textile-like material. The same is true as regards the production and the washing of the wiping element 4.

Normally the textile or textile-like material of both the wiping element 4 and the fixing strips 5 is a synthetic fiber material or a synthetic fiber/natural fiber mixture.

Particularly when the fixing strips 5 are made of textile or textile-like material, it is convenient to attach the fixing strips 5 by stitching them to the wiping element 4. This is also the method of application shown in the illustrated embodiment. The seams 6 with which the fixing strips 5 are attached to the wiping element 4 can be seen.

There are also many other possible ways of securing the fixing strips 5 to the wiping element 4. For example, it would be possible to fix the fixing strips 5 to the wiping element 4 by means of tacks or rivets. When using plastics material it would also be possible to weld together the materials of the fixing strips 5 and wiping element 4. By and large however it has been found in practice that stitching the fixing strips 5 to the wiping element 4 is particularly convenient, in the same way as the insert pockets known from the prior art are stitched at their edges.

The stitching of the fixing strips 5 to the wiping element 4 can be performed without any problems since in this case only two flat surfaces have to be stitched to one another. Also, the stitching does not have to take place in the edge region of the wiping element 4, and can therefore be carried out independently and in a substantially more permanent manner.

If the wiping element holder 1 is of a suitably matching shape, the fixing strips 5 may be elastically non-stretchable in their longitudinal direction. In this case it is then particularly convenient if the fixing strips 5 consist of a similar material to that of the base fabric of the wiping element 4. In the case of wiping element holders 1 with a fixed plate or fixed wire frame it is recommended however that the fixing strips 5 be designed so as to be elastically stretchable in their longitudinal direction, since only then can it be ensured that the wiping element 4 is actually securely fixed to the wiping element holder 1.

In practice it has been found that if the fixing strips 5 are suitably shaped, in particular have the appropriate thickness, then they directly stand apart from the upper side of the wiping element 4 and thus already by themselves form an insert opening. The insertion of the ends of the wiping element holder 1 is thus very simple, and the fixing strips 5 do not first of all have to be lifted from the wiping element 4. A manual intervention is also unnecessary, which has to be regarded as a significant advantage. This is particularly the case with a wiping element holder 1 having a foldable plate or foldable wire frame, which should of course in any case be particularly easy to handle.

Nothing has been said up to now as regards the arrangement of the position fixing arrangements 7 on the wiping element holder 1. FIGS. 1 and 3 show the wiping element holder 1, in this case provided with a foldable plate that can fold about a covered folding axis 8, the folding operation being executed by a conventional actuating lever 9, in this case a plate-type lever. The illustrated embodiment of a wiping element holder 1 is in this case designed as a magnetic holder, i.e. the inclined position of the wiping element holder 1 is ensured by the magnetic force of a covered installed permanent magnet. By operating the actuating lever 9 this connection is released and the wiping element holder 1 can be folded up. To install the wiping element 4 the wiping element holder 1 simply has to be pressed downwards, whereupon the ends thread underneath the fixing strip 5 and the two parts of the wiping element holder 1 where they join together snap tight under the action of the magnet.

In principle it could be envisaged that in order to form the position fixing arrangements 7 the wiping element holder 1 could be designed so as to taper trapezoidally at the ends associated with the fixing strips 5 and the intended position of the fixing strips 5 could lie in this trapezoidally-tapering region. This variant is illustrated diagrammatically in FIG. 4*a*. Slightly trapezoidally-tapering wiping element holders have already been used in the prior art. The illustrated trapezoidal shape served however only to facilitate the operation of threading into the insert pockets stitched on three sides, while the positional fixing was achieved by the transverse straps arranged at the end and coming to rest on the front end of the insert pockets. From now on the sides of the trapezoidally-tapering region are used to ensure the longitudinal arrangement of the wiping element 4 on the wiping element holder 1, since the intended position of the fixing strips 5 is situated there.

A preferred embodiment that is particularly convenient in practice is illustrated in FIGS. 1 and 3. In this case it is envisaged that the position fixing arrangements 7 of the wiping element holder 1 are edge recesses in the wiping element holder 1 starting from the ends associated with the fixing strips 5, in which the fixing strips 5 lie in the intended position. This arrangement with, as it were, angle-shaped edge recesses at the ends of the wiping element holder 1 has several particular advantages. On the one hand the fixing strips 5 may be shorter than the normal width of the wiping element holder 1. The seams 6 may accordingly lie further inwardly on the surface of the wiping element 4. Furthermore the wiping element holder 1 is substantially lighter due to the edge recesses 7 starting from the ends, and a reduction in weight of at least ca. 14 g was achieved in a structurally implemented embodiment. Correspondingly less raw material has to be used, resulting in correspondingly lower costs. Also, in professional use cleaning staff comment positively on the somewhat lower weight of the wiping element holder 1.

Figure 4:
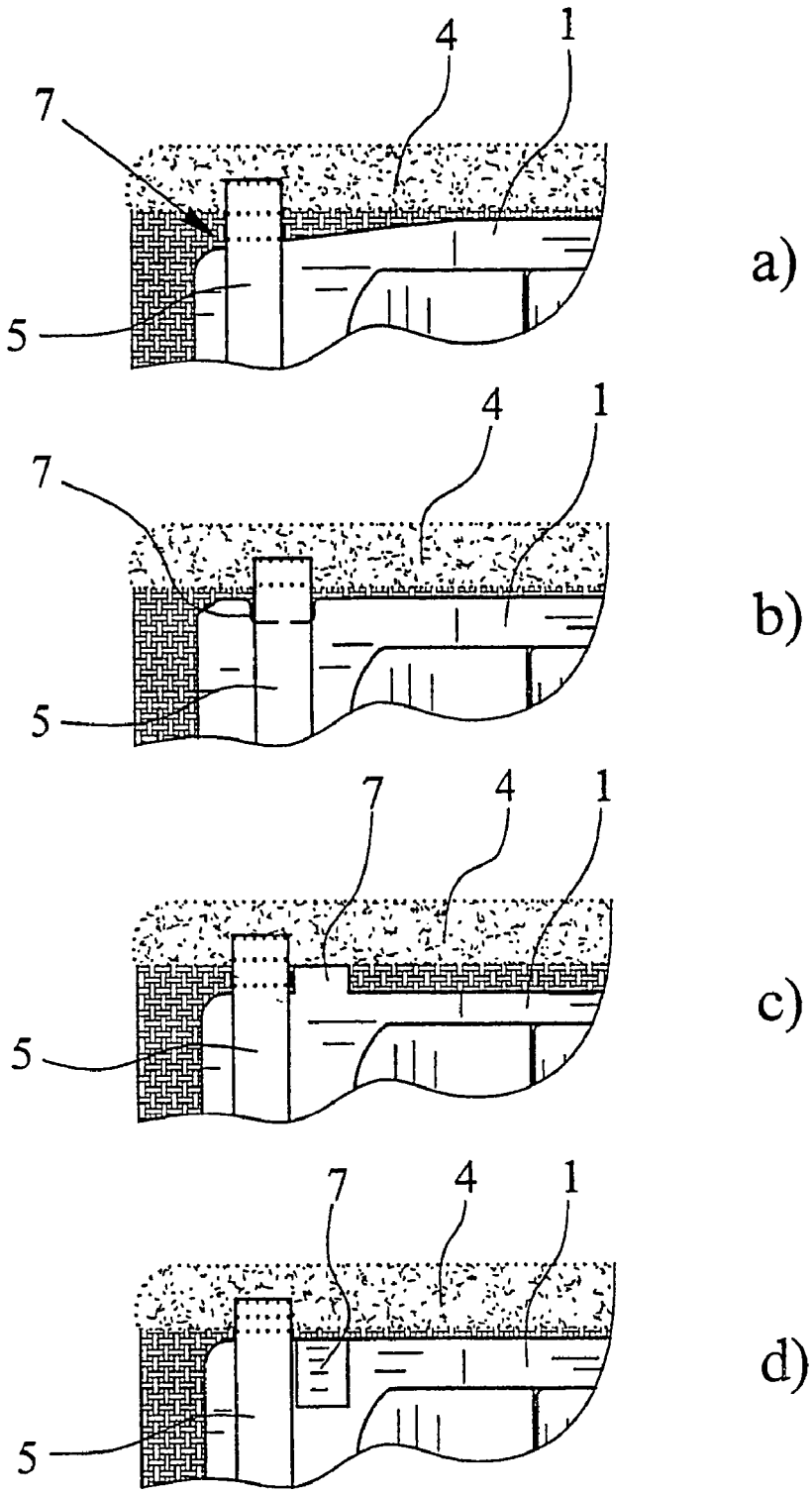
FIG. 4 shows in the component parts a, b, c, d various alternative ways of securing the wiping element to the wiping element holder.

A further alternative is shown in FIG. 4*b*. This alternative is characterized by the fact that the position fixing elements 7 of the wiping element holder 1 are edge recesses arranged on the longitudinal sides of the wiping element holder 1 running transversely to the fixing strips 5, in which recesses the fixing strips 5 lie in the desired position. In this case a permanent fixing of the wiping element 4 on the wiping element holder 1 can of course be achieved probably only in conjunction with fixing strips 5 that are at least somewhat elastically stretchable in their longitudinal direction.

In all cases it may also be envisaged that the edge recesses 7 are connected by a recess running on the upper side of the wiping element holder 1.

Instead of using recesses, it can also be envisaged that the position fixing arrangements 7 of the wiping element holder 1 are edge projections arranged on the longitudinal sides of the wiping element holder 1 running transverse to the fixing strips 5, which projections prevent the fixing strips 5 slipping further onto the wiping element holder 1. This variant is illustrated in FIG. 4*c*. FIG. 4*d* shows a corresponding variant with a projection 7 that runs on the upper side of the wiping element holder 1 and thereby prevents the end of the wiping element holder 1 slipping through underneath the fixing strips 5. The various structural variants may of course also be combined with one another in a suitably matching manner.

Figure 5:
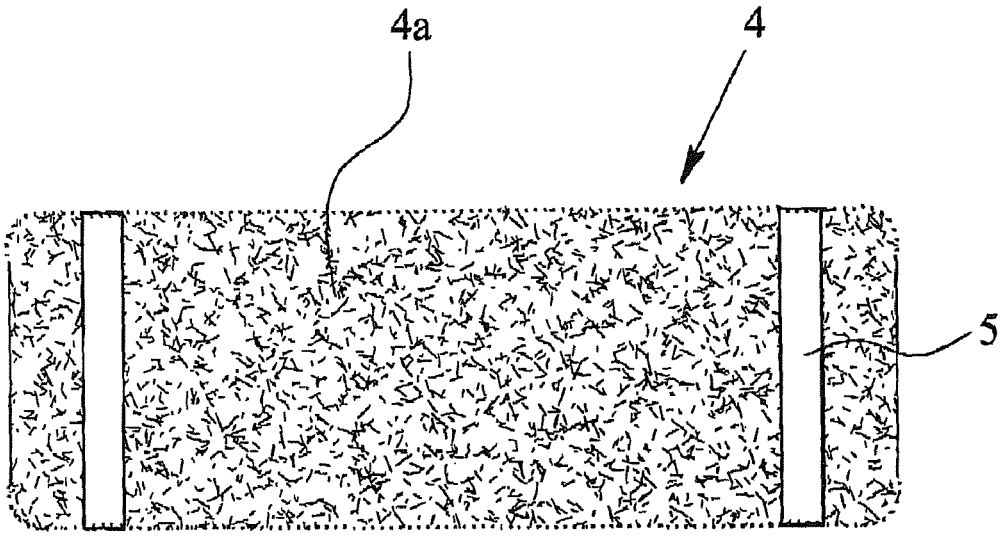
FIG. 5 shows an especially preferred embodiment of a wiping element according to the invention seen from one of the active cleaning sides.
Figure 6:
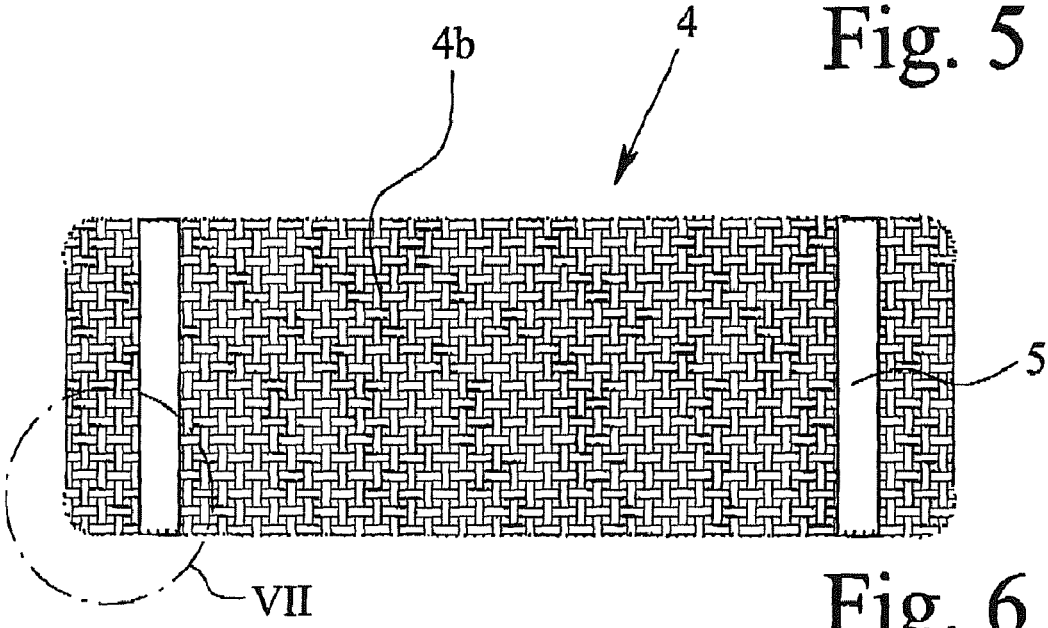
FIG. 6 shows the wiping element from FIG. 5 seen from the other active cleaning side.
Figure 7:
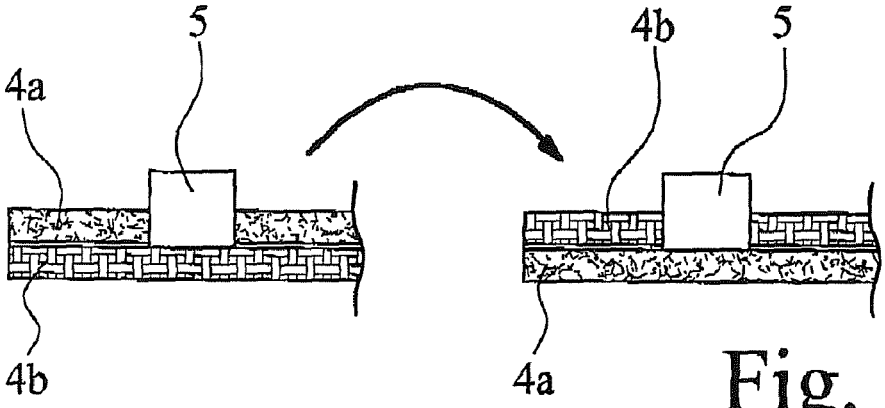
FIG. 7 shows a schematic illustration for elucidation of the reversal procedure of the wiping element according to FIGS. 5 and 6.

FIGS. 5, 6 and 7 show a further, very interesting variant of a wiping device of the type in question. This variant is distinguished through the fact that the wiping element 4 is reversible. The reversibility of the wiping element 4 is facilitated by the fact that the fixing strips 5 are attached to the edges of the wiping element 4 such that, in both positions of the wiping element 4, the fixing strips have essentially the same relative position to the wiping element 4. FIG. 5 shows one position of the wiping element 4 with one active cleaning layer 4*a* at the top, while FIG. 6 shows the other position of the wiping element 4 with the other active cleaning layer 4*b* at the top.

The fixing strips 5, especially when they are elastic, need not be attached precisely to the edge, but the reversibility is greatly aided when such an attachment is realized.

FIG. 7 shows, as indicated partially in FIG. 6 with a dot-and-dash circular line, the reversing process of the wiping element 4, not drawn true to scale but, rather, in schematic fashion for purposes of illustration.

The wiping element 4 can, irrespective of its reversibility, be produced from a single layer forming the front and back sides. Especially advantageous, however, is the implementation illustrated here, in which the wiping element 4 consists of two active cleaning layers 4*a* and 4*b* that are firmly joined together, especially stitched together. This is shown in FIGS. 5, 6 and 7.

Two active cleaning layers 4*a* and 4*b* have the advantage that, if necessary, they can be differently constructed, in other words have different structures and/or surfaces and/or materials or material compositions. One can thereby achieve different cleaning effects, for example, one layer 4*b* producing a coarse cleaning using rough material and the other layer 4*a* producing a fine cleaning using especially soft material. Such a configuration is of great interest precisely for hygienically demanding applications.

In addition to the flexibility in the design of the wiping element 4 achieved in the case of reversibility, in particular when two layer 4*a* and 4*b* are used, the usability of both sides for cleaning purposes is also of considerable advantage. The cleaning performance is practically doubled relative to the subsequently required washing process.

The construction of the wiping element 4 from two active cleaning layers 4*a* and 4*b* that are firmly joined together, especially stitched together, has the further advantage that the fixing strips 5 can also be attached without problem in the same process. They are simply anchored at the end sides between the layers 4*a* and 4*b*, in particular stitched in between the latter.

As has already been explained in the general part of the description, the invention also provides a wiping element holder 1 per se that is used in a wiping device according to the invention, as well as a wiping element 4 per se that is characterized by the fixing strips 5.

Instead of a plate-type or frame-type wiping element holder 1, one can also make use of a wiping element holder 1 that has a hollow chamber for receiving a larger volume of cleaning fluid or is formed by such a hollow chamber. In this connection, reference may be made to DE 44 34 496 A1, the disclosure contents of which are made with reference to the disclosure contents of the present patent application. Such a hollow chamber, which forms the wiping element holder 1 or is a part of the wiping element holder 1, is connected via at least one outlet in the wiping element holder to the wiping element 4 fastened to the wiping element holder 1, so that cleaning fluid can flow continuously.

The use of position fixing arrangements 7 according to the teaching of the invention is likewise recommended for a wiping element 1 having a hollow chamber, which preferably displays a substantially circular cross section. For this purpose, one can for example drop the diameter of the hollow chamber at the ends to a smaller dimension, so that the position fixing arrangements 7 are formed by edge recesses and connecting recesses running on the upper side. Another variant is the combination of additionally placed position fixing arrangements 7 in the form of edge projections or projections on the upper side.

In both cases, when application is made of a hollow chamber as the wiping element holder 1 or as part of the wiping element holder 1 the use of elastically stretchable fixing strips is to this extent recommended.

The invention claimed is:

1. A floor wiping device comprising:

a wiping element holder including a first longitudinal edge, a second longitudinal edge opposite the first longitudinal edge, a first end, a second end opposite the first end, an upper side and a plurality of edge projections wherein each of the plurality of edge projections project from the upper side of the holder, in a direction that the upper side faces, the first and second longitudinal edges extending substantially parallel to one another, the first and second ends extending between the first and second longitudinal edges, the upper side being bounded by the first and second longitudinal edges and the first and second ends, a first of the plurality of edge projections being located in proximity to an intersection of the first longitudinal edge with the first end and offset from the first end, a second of the plurality of edge projections being located in proximity to an intersection of the first longitudinal edge with the second end and offset from the second end, a third of the plurality of edge projections being located opposite the first of the plurality, in proximity to an intersection of the second longitudinal edge and the first end, and a fourth of the plurality of edge projections being located opposite the second of the plurality, in proximity to an intersection of the second longitudinal edge and the second end; and a wiping element of textile or textile-like material including a first longitudinal edge, a second longitudinal edge opposite the first longitudinal edge, a first narrow fixing strip and a second narrow fixing strip, each of the narrow fixing strips extending across a surface of the wiping element, between the first and second longitudinal edges of the wiping element, and being attached, at either end thereof, to the wiping element, the attached narrow fixing strips being longitudinally spaced apart from one another across the surface of the element;

wherein the wiping element is secured to the wiping element holder by inserting the first end of the holder in between the first narrow fixing strip and the surface of the wiping element and inserting the second end of the holder in between the second narrow fixing strip and the surface of the wiping element, such that the first and second narrow fixing strips approximately abut the first and third of the plurality of projections of the holder and the second and fourth of the plurality of projections of the holder, respectively, without covering any of the edge projections, and the first and second ends of the wiping elements holder extend past the first and second narrow fixing strips, respectively.

2. The wiping device according to claim 1 wherein the narrow fixing strips consist of the same material as the textile or textile-like material of the wiping element.

3. The wiping device according to claim 1, wherein the textile or textile-like material is a synthetic fiber material or a synthetic fiber/natural mixed material.

4. The wiping device according to claim 1, wherein the narrow fixing strips are attached to the wiping element by stitching.

5. The wiping device according to claim 1, wherein the narrow fixing strips are not elastically stretchable in their longitudinal direction.

6. The wiping device according to claim 1, wherein the narrow fixing strips are spaced apart from the surface of the wiping element prior to securing the wiping element to the wiping element holder.

7. The wiping device according to claim 1, wherein the wiping element holder comprises a fixed plate.

8. The wiping device according to claim 1, wherein the wiping element holder comprises a foldable plate.

9. The wiping device according to claim 1, wherein the wiping element is reversible between a first secured position, with respect to the wiping element holder, and a second secured position, with respect to the wiping element holder, and the narrow fixing strips are attached to the longitudinal edges of the wiping element such that, in both positions of the wiping element, the narrow fixing strips have essentially the same relative position to the wiping element.

10. The wiping device according to claim 9, wherein the wiping element consists of two active cleaning layers that are firmly joined together.

11. The wiping device according to claim 10, wherein the layers have different structures, surfaces, materials or material compositions.

12. The wiping device according to claim 10, wherein the narrow fixing strips are attached, at either end thereof between the layers.

* * * * *